US011739906B2

(12) United States Patent
Liu et al.

(10) Patent No.: US 11,739,906 B2
(45) Date of Patent: Aug. 29, 2023

(54) VEHICLE LAMP MODULE, VEHICLE LAMP AND VEHICLE

(71) Applicant: HASCO VISION TECHNOLOGY CO., LTD., Shanghai (CN)

(72) Inventors: Yang Liu, Shanghai (CN); He Zhu, Shanghai (CN); Wenhui Sang, Shanghai (CN); Zhaoyu Chen, Shanghai (CN); Shiqun He, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 18 days.

(21) Appl. No.: 17/640,207

(22) PCT Filed: Oct. 30, 2020

(86) PCT No.: PCT/CN2020/125028
§ 371 (c)(1),
(2) Date: Mar. 3, 2022

(87) PCT Pub. No.: WO2021/103923
PCT Pub. Date: Jun. 3, 2021

(65) Prior Publication Data

US 2022/0316679 A1 Oct. 6, 2022

(30) Foreign Application Priority Data

Nov. 30, 2019 (CN) ..... 201911208408.7

(51) Int. Cl.

| | |
|---|---|
| ***F21S 41/32*** | (2018.01) |
| ***F21S 45/47*** | (2018.01) |
| ***F21S 41/148*** | (2018.01) |
| ***F21S 41/43*** | (2018.01) |

(52) U.S. Cl.
CPC ..... *F21S 45/47* (2018.01); *F21S 41/148* (2018.01); *F21S 41/32* (2018.01); *F21S 41/43* (2018.01)

(58) Field of Classification Search
CPC .. F21S 41/32; F21S 41/47; F21S 41/39; F21S 41/148; F21S 41/30; F21S 41/40;
(Continued)

(56) References Cited

U.S. PATENT DOCUMENTS

2015/0266407 A1 9/2015 Rubia Mena et al.
2017/0146211 A1 5/2017 Wu
(Continued)

FOREIGN PATENT DOCUMENTS

CN 101266029 A 9/2008
CN 106439678 A 2/2017
(Continued)

OTHER PUBLICATIONS

Search English translation of JP-2018137125-A (Year: 2018).*
Search English translation of JP-2017027879-A (Year: 2017).*
Search English translation of FR-3058501-A1 (Year: 2018).*

*Primary Examiner* — Omar Rojas Cadima
(74) *Attorney, Agent, or Firm* — Volpe Koenig

(57) ABSTRACT

A vehicle lamp module, a vehicle lamp and a vehicle. The vehicle lamp module comprises a circuit board, at least one reflector and light shields in one-to-one correspondence with the reflectors. Each of the light shields comprises a plurality of light shield positioning plugs, and the circuit board comprises light shield positioning sockets corresponding to the light shield positioning plugs, thereby realizing direct positioning of the light shields and the circuit board. The light shields and the reflector are respectively and directly positioned with the circuit board, such that accurate and good positioning among vehicle lamp optical element systems consisting of the circuit board, the light shields and the
(Continued)

43 reflectors is realized, and position errors caused by indirect positioning among optical elements due to the fact that a radiator is used as a positioning piece are avoided, ensuring light form effect, and improving the module performance.

20 Claims, 11 Drawing Sheets

(58) Field of Classification Search
CPC . F21S 45/47; F21S 45/49; F21S 43/37; F21V 17/10; F21W 2102/155; B60Q 1/04
See application file for complete search history.

(56) References Cited

U.S. PATENT DOCUMENTS

| | | | |
|---|---|---|---|
| 2017/0234503 | A1 | 8/2017 | Buffone et al. |
| 2017/0248287 | A1 | 8/2017 | Yasuda |
| 2017/0370550 | A1 | 12/2017 | Japs et al. |
| 2018/0112844 | A1 | 4/2018 | Bowles et al. |

FOREIGN PATENT DOCUMENTS

| | | | | | |
|---|---|---|---|---|---|
| CN | 108061277 | A | | 5/2018 | |
| CN | 111486407 | A | | 8/2020 | |
| DE | 102017104841 | A1 | | 9/2018 | |
| EP | 2395279 | A2 | | 12/2011 | |
| FR | 3058501 | A1 | * | 5/2018 | ..... F21S 41/141 |
| JP | 2011243502 | A | | 12/2011 | |
| JP | 2014007106 | A | | 1/2014 | |
| JP | 2016007911 | A | | 1/2016 | |
| JP | 2016100231 | A | | 5/2016 | |
| JP | 2017027879 | A | * | 2/2017 | ..... F21S 41/19 |
| JP | 2018077981 | A | | 5/2018 | |
| JP | 2018137125 | A | * | 8/2018 | ..... F21S 41/19 |
| WO | 2012145056 | A1 | | 10/2012 | |

* cited by examiner

VEHICLE LAMP MODULE, VEHICLE LAMP AND VEHICLE

CROSS REFERENCE OF RELATED APPLICATIONS

The present application is a 35 U.S.C. § 371 national stage of PCT/CN2020/125028, which is entitled "VEHICLE LAMP MODULE, VEHICLE LAMP AND VEHICLE" and claims priority to the Chinese Patent Application filed in the Chinese Patent Office on Nov. 30, 2019 with the application number 201911208408.7, both of which are incorporated herein by reference as if set forth in their entirety.

TECHNICAL FIELD

The invention relates to a lighting device, in particular to a vehicle lamp module. In addition, the invention further relates to a vehicle lamp including the vehicle lamp module and a vehicle including the vehicle lamp.

BACKGROUND

Along with gradual maturation and stability of development of the vehicle industry, vehicle lamp modules are more and more diversified, and customers put forward more and higher requirements on comprehensive performance of the vehicle lamp modules, such as light form effect, module manufacturing cost and service life. As one of the vehicle lamp modules, the reflective vehicle lamp module adopts a reflector as an optical element of the vehicle lamp module, and has very high requirements on the positioning and mounting precision of all components.

A vehicle headlamp is disclosed in the Chinese patent CN108061277A, a reflective vehicle lamp module is required to be protected, the reflective vehicle lamp module includes a reflection unit, a light source unit and a heat release component, and the reflection unit and the heat release component are fixed in a matched and riveted mode through heat release component fixing ribs and heat release component fixing sockets. The light source unit, the reflecting unit and the heat release component are fixed in a matched and riveted mode through inserting light source unit fixing ribs into light source unit fixing sockets and light source unit fixing ribs insertion holes.

The American patent US20180112844A1 discloses a vehicle lamp and also requires to protect a reflective vehicle lamp module, the reflective vehicle lamp module includes a reflector, a light shield, a circuit board and a radiator, a positioning plug is arranged on the radiator, the circuit board and the reflector are respectively provided with a positioning socket for the positioning plug to pass through, the positioning plug and the positioning socket are matched to position the circuit board, the reflector and the radiator, and the light shield is welded on the circuit board.

Optical elements (a reflector and a circuit board provided with a light source) in the two patents are positioned through an indirect component, namely a radiator, and due to the fact that manufacturing errors and assembly errors exist among the components, the positioning precision is low, the precision of an optical system is influenced, and then the light form effect is influenced.

The effect of an opening in the patent CN108061277A is the same as that of a light shield in the patent US20180112844A1, a light-emitting element is exposed from the opening, the opening is arranged on a base part, namely, the base part has the light shielding effect, but the base part and a reflecting unit are integrally arranged, and the base part and a reflector main body are both made of resin, so that the heat resistance of the base part is very low, and the service life of the base part is influenced.

In addition, the relative positions of light forms formed by the three reflectors in the patent CN108061277A and the patent US20180112844A1 cannot be adjusted, no dimming structure exists in the patent CN108061277A, and in the patent US20180112844A1 the radiator and the circuit board are both integrated pieces and do not have the dimming function. As a result, the cut-off lines of the main low-beam light form and the auxiliary low-beam light form cannot be aligned, and the relative positions of the low-beam light form and the high-beam light form are easy to deviate, so that the cut-off lines of the light forms are not good, the light form effect is influenced, and the requirements of laws and regulations are not met.

SUMMARY

On the first aspect, the problem to be solved by the present invention is to provide a vehicle lamp module, the vehicle lamp module adopts a direct positioning mode, the positioning precision is improved, and the light form effect is ensured.

On the second aspect, the technical problem to be solved by the invention is to provide a vehicle lamp which adopts a direct positioning mode, so that the positioning precision is improved, and the light form effect is ensured.

Furthermore, the technical problem to be solved by the invention is to provide a vehicle, the vehicle lamp of the vehicle adopts a direct positioning mode, the positioning precision is improved, and the light form effect is ensured.

In order to achieve the above objective, on one hand, the invention provides the vehicle lamp module, the vehicle lamp module includes a circuit board, at least one reflector and light shields in one-to-one correspondence with the reflectors, wherein a plurality of light shield positioning plugs are arranged on the light shield; and light shield positioning sockets corresponding to the light shield positioning plugs are arranged in the circuit board so as to realize direct positioning of the light shield and the circuit board.

Preferably, two light shield positioning plugs are arranged on each light shield.

Preferably, first through holes for the light shield positioning plugs to pass through are arranged in a radiator corresponding to the circuit board, and the light shield positioning plug is not in contact with an inner wall of the first through hole.

Preferably, heat-conducting glue is arranged between the light shield positioning plug and the circuit board.

Preferably, at least one reflector is provided with a plurality of reflector positioning plugs, and the circuit board corresponding to the reflector is provided with reflector positioning sockets corresponding to the reflector positioning plugs to realize direct positioning of the reflector and the circuit board.

Further preferably, two reflector positioning plugs are arranged on each reflector.

Preferably, second through holes for the reflector positioning plugs to pass through are arranged in the radiator corresponding to the circuit board, and the reflector positioning plug is not in contact with the inner wall of the second through hole.

Preferably, the number of the reflectors is multiple, one of the reflectors is provided with a plurality of the reflector positioning plugs, and dimming structures enabling the other reflectors to move relative to the corresponding circuit boards are arranged between the other reflectors and the corresponding circuit boards.

Specifically, the dimming structure comprises at least one guide column arranged on a bottom face of each of the other reflectors and circuit board guide holes which are arranged in the corresponding circuit board and correspond to the guide columns, and the circuit board guide holes extend in the front-back direction of the circuit boards.

Preferably, the outer side edge of the guide column is in contact with the inner wall of the circuit board guide hole, and the inner side edge of the guide column is not in contact with the inner wall of the circuit board guide hole.

Preferably, the guide columns are cylinders, one guide column is arranged on one side of each of the other reflectors, two guide columns are arranged on the other side of each of the other reflectors, and the outer side edges of the two circuit board guide holes corresponding to the two guide columns located on the same side are located on the same straight line.

Preferably, radiator guide holes corresponding to the circuit board guide holes are arranged in the radiator corresponding to the circuit board, and the guide columns sequentially pass through the circuit board guide holes and the radiator guide holes.

Preferably, at least one light shield riveting column is arranged on the light shield, circuit board connecting holes corresponding to the light shield riveting columns are arranged in the circuit board, radiator connecting holes corresponding to the light shield riveting columns are arranged in the radiator corresponding to the circuit board, and the light shield riveting columns sequentially pass through the circuit board connecting holes and the radiator connecting holes to rivet the light shield, the circuit board and the radiator.

Preferably, heat-conducting glue is arranged between the light shield riveting column and the circuit board.

Preferably, gaps allowing the light shield riveting columns to move in the connecting holes exist between the outer surfaces of the light shield riveting columns and the inner surfaces of the circuit board connecting holes and the radiator connecting holes.

Preferably, mounting holes are arranged in the reflector, the circuit board and the radiator corresponding to the circuit board are respectively provided with via holes, and the via holes are connected with the mounting holes through fasteners to enable the fixed connection among the radiator, the circuit board and the reflector.

Preferably, a first convex rib protruding out of the lower surface of the reflector is arranged on the periphery of the mounting hole, and the first convex rib is in contact with the upper surface of the circuit board.

Preferably, a reflector riveting column is arranged on the lower surface of the reflector, and a riveting hole matched with the reflector riveting column is arranged in the circuit board.

Preferably, a second convex rib is arranged on the periphery of the reflector riveting column, and the second convex rib is in contact with the upper surface of the circuit board.

On the second aspect, the invention further provides a vehicle lamp. The vehicle lamp includes the above-mentioned vehicle lamp module.

On the third aspect, the invention further provides a vehicle. The vehicle is provided with the above-mentioned vehicle lamp.

Through the above technical solution, the invention has the following beneficial effects:

1. The circuit board is taken as a reference, the light shield and the reflector are respectively and directly positioned with the circuit board, accurate and good positioning among vehicle lamp optical element systems consisting of the circuit board, the light shield and the reflector is realized, the radiator only plays a role in heat dissipation and does not play a role in positioning, and position errors caused by indirect positioning between the optical elements due to the fact that the radiator serves as a positioning piece are avoided, the light form effect is guaranteed, and the module performance is improved;

2. In order to be matched with a positioning structure, the light shield, the circuit board and the radiator are connected in a riveting manner, so that reliable connection is ensured; and 3. A dimming structure is arranged, so that the relative positions of a plurality of light forms in the up-and-down direction can be adjusted, the light forms meet the requirements of laws and regulations, and the light form effect is ensured.

DESCRIPTION OF REFERENCE SIGNS

| | | | |
|---|---|---|---|
| 1 | reflector | 11 | reflector positioning plug |
| 12 | mounting hole | 13 | first convex rib |
| 14 | reflector riveting column | 15 | second convex rib |
| 16 | guide column | 2 | light shield |
| 21 | light shield positioning plug | 22 | light shield riveting column |
| 3 | circuit board | 31 | light shield positioning socket |
| 32 | circuit board connecting hole | 33 | reflector positioning socket |
| 34, 44 | via hole | 35 | riveting hole |
| 36 | circuit board guide hole | 4 | radiator |
| 41 | first through hole | 42 | radiator connecting hole |
| 43 | second through hole | 45 | radiator guide hole |
| 5 | screw | 6 | support |

DETAILED DESCRIPTION OF THE EMBODIMENTS

The specific implementation modes of the present invention are described in detail according to the accompanying drawings. It should be understood that the specific implementation modes described herein are only used to illustrate and interpret the present invention, but not to limit the present invention.

Figure 5:
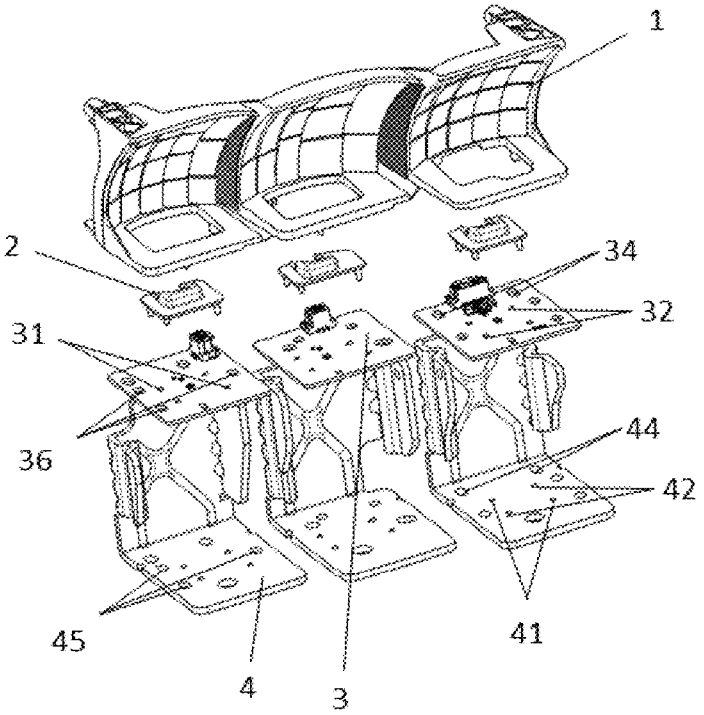
FIG. 5 is another decomposition schematic diagram of FIG. 1, wherein the support is not shown.
Figure 6:
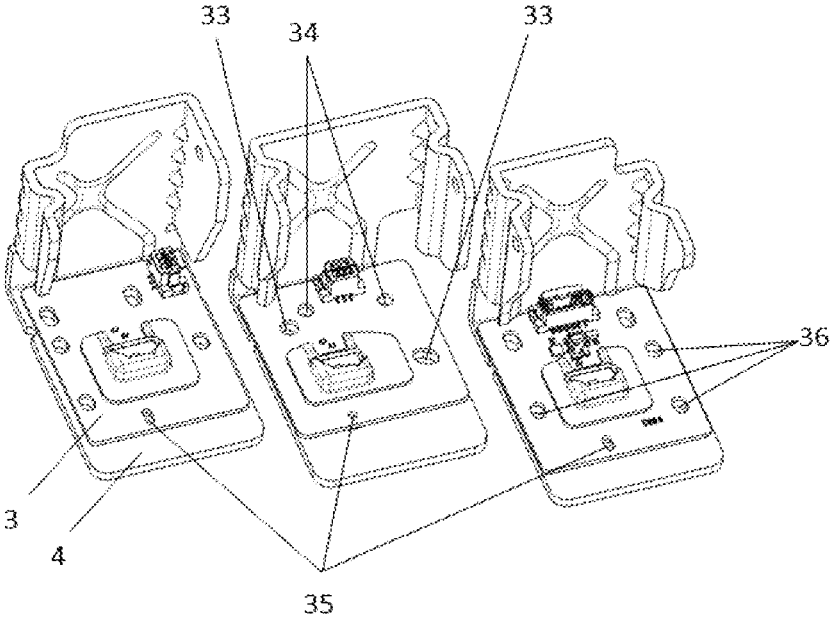
FIG. 6 is a schematic diagram of the assembly structure of the light shield, the circuit board and the radiator in the present invention.
Figure 7:
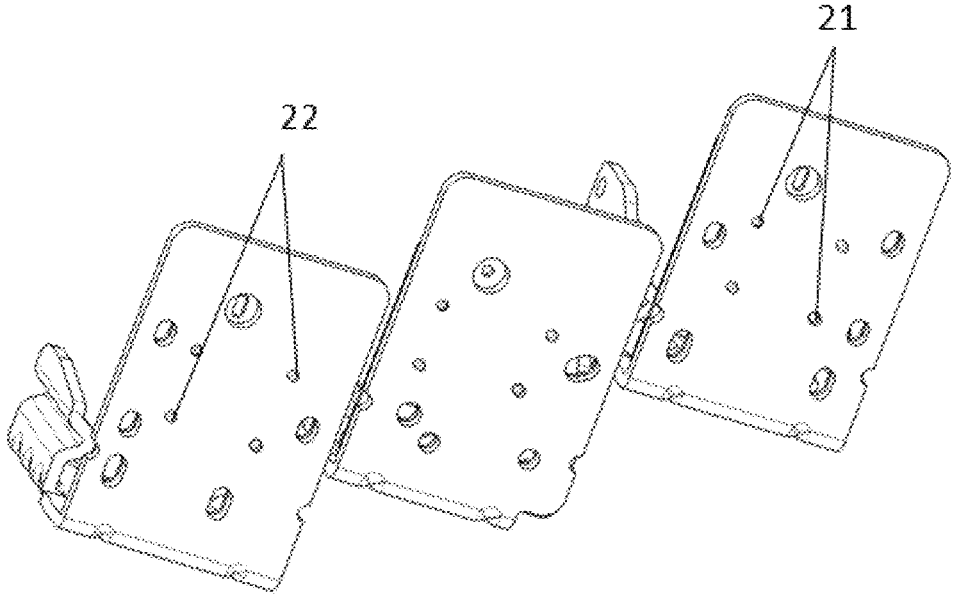
FIG. 7 is a structure schematic diagram of FIG. 6 from another angle.
Figure 8:
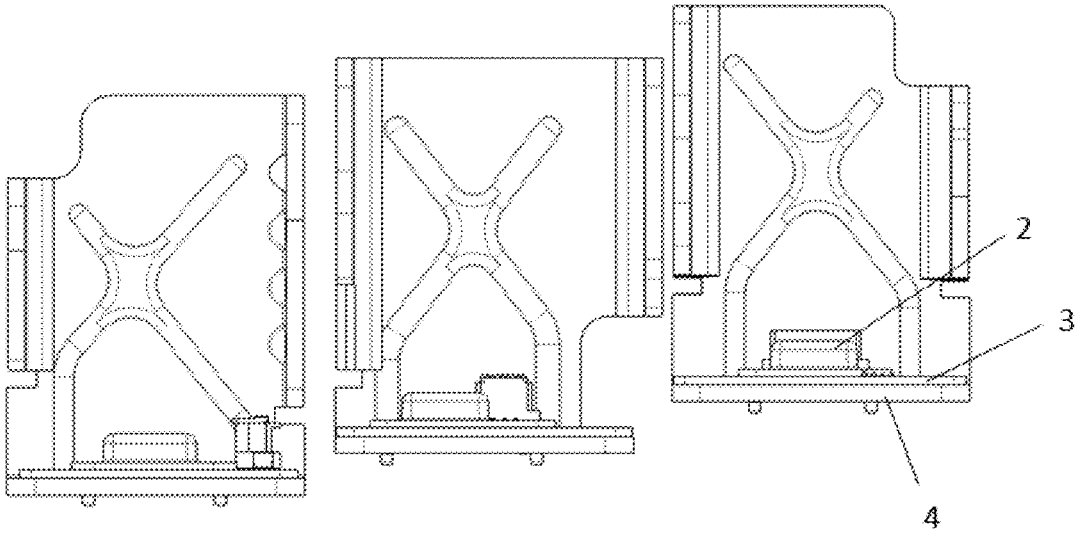
FIG. 8 is a front view of FIG. 6.
Figure 9:
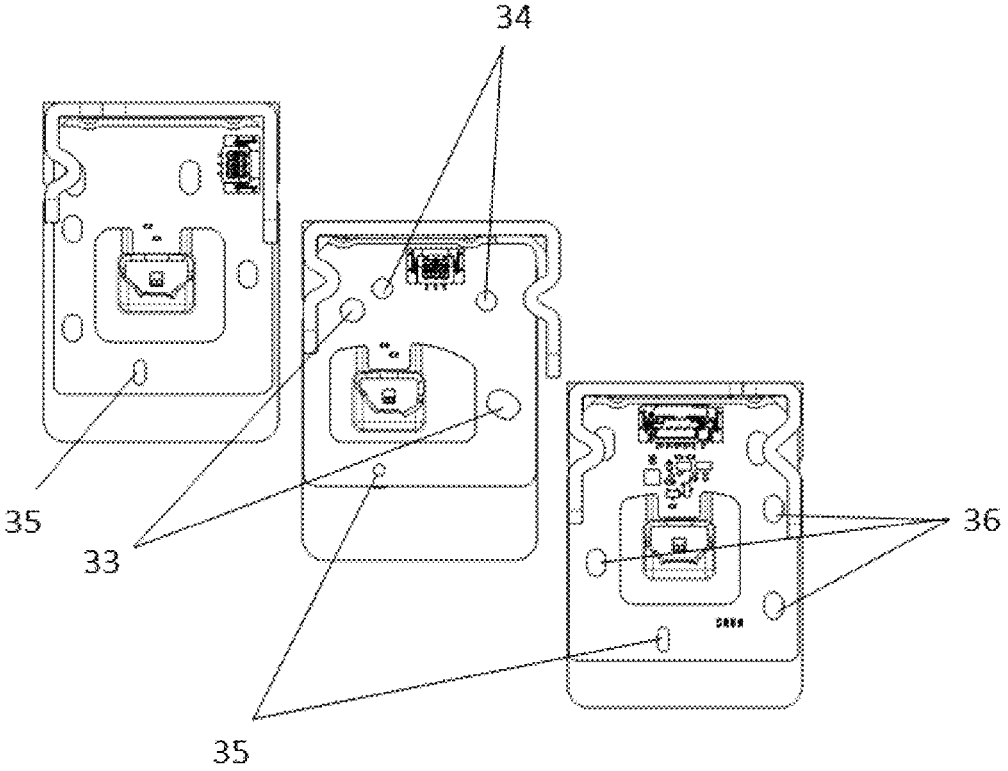
FIG. 9 is a top view of FIG. 6.
Figure 10:
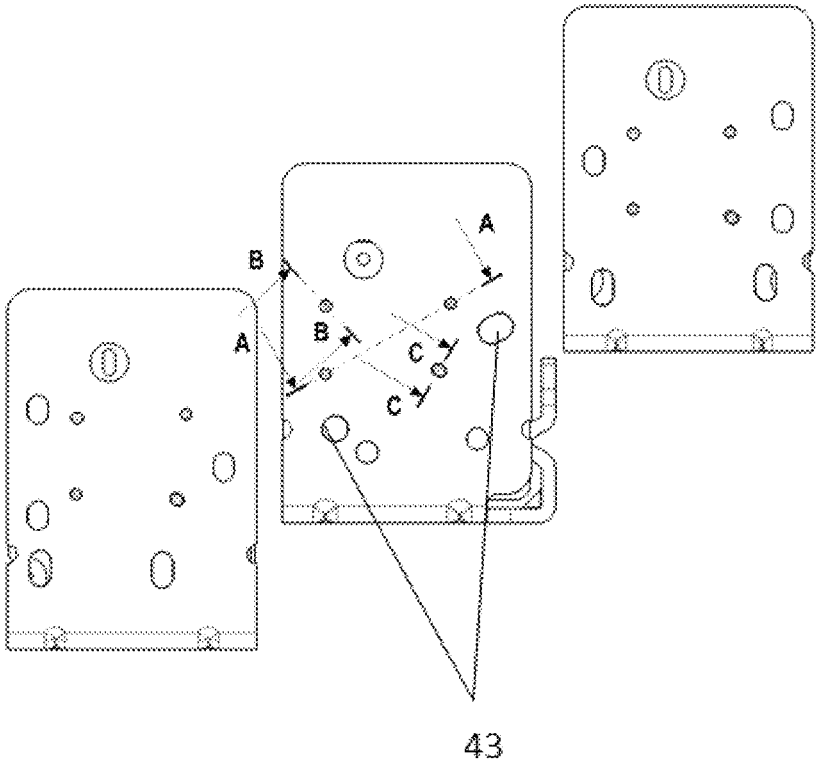
FIG. 10 is a bottom view of FIG. 6.
Figure 11:
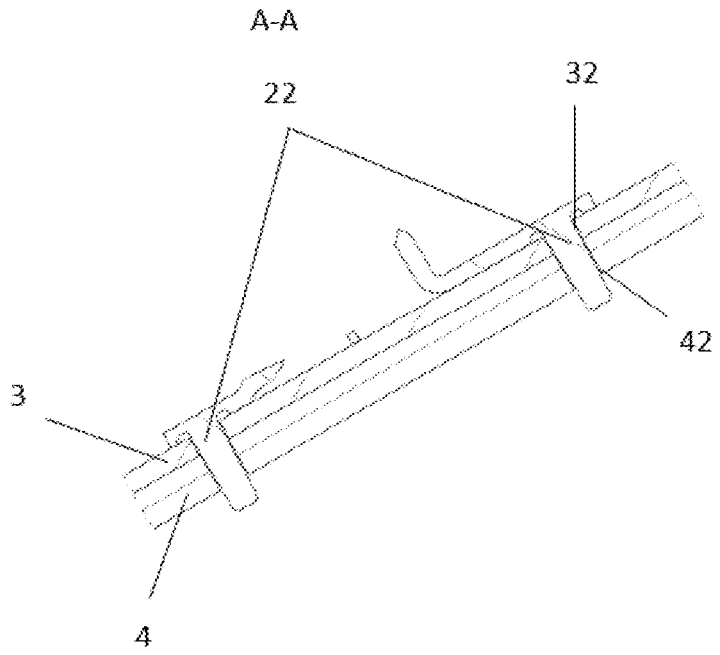
FIG. 11 is an A-A profile schematic diagram of FIG. 10.

The orientation or position relation indicated by the terms of "upper", "lower", "front", "rear", "left", "right" and the like is based on the orientation or position relation shown in the FIG. 5, namely, the orientation or position relation is the same as the up, down, front, rear, left and right directions of the vehicle lamp module in the using state. The orientation or position relation is only for the convenience of describing the present invention and simplifying the description, and does not indicate or imply that referred devices or elements must have a specific orientation, be constructed and operated in a specific orientation, and therefore cannot be understood as a limitation to the present invention.

Furthermore, the terms "first", "second" are only used for the purpose of description, but not understood to indicate or imply relative importance or implicitly indicate the number of technical features indicated, so that features defined with "first", "second" may explicitly or implicitly include one or more of the features.

In the description of the invention, it should be noted that, the term "installation" and "connection" should be subjected to generalized understanding unless specific regulations and limits are provided, for example, the term "connection" can be fixed connection, detachable connection or integrated connection; the two elements can be directly connected or indirectly connected through an intermediate medium, and the two elements can be internally communicated or interacted with each other. For those skilled in the art, the specific meanings of the terms in the invention can be understood according to specific conditions.

As shown in FIG. 1-FIG. 5, the vehicle lamp module includes a radiator 4, a circuit board 3, at least one reflector 1 and light shields 2 in one-to-one correspondence with the reflectors 1, due to the fact that part of direct light emitted by a light source may cause dazzling to pedestrians or oncoming vehicle drivers, in order to avoid dazzling and avoid traffic accidents, the light shields 2 are arranged. The light shields 2 are arranged near the light source, so they can block part of the direct light propagating towards a lens, and can also block scattered or diffused light from the light source from being projected towards a specific area of the reflector, so that the expected light form pattern is limited, and unwanted light and glare outside the expected light form pattern are prevented. Due to the fact that the light shield 2 is close to the light source, in order to prolong the service life of the light shield 2, the light shield 2 is made of metal with high strength, and ADC12 (under Japanese standard, also known as 12 # aluminum material, which is an Al—Si—Cu alloy and a die-casting aluminum alloy) is preferably selected as the material of the light shield 2.

In order to improve the heat conduction performance of the radiator 4, the radiator 4 in the present invention is made of aluminum, compared with a radiator made of aluminum alloy in the prior art, the radiator 4 is high in heat conduction performance, but low in strength and prone to deformation, so that structures such as positioning plugs and riveting columns cannot be machined on the radiator 4, however the light shield 2 is made of a high-strength metal material, so positioning plugs and riveting columns can be arranged on the light shield 2.

Figure 3:
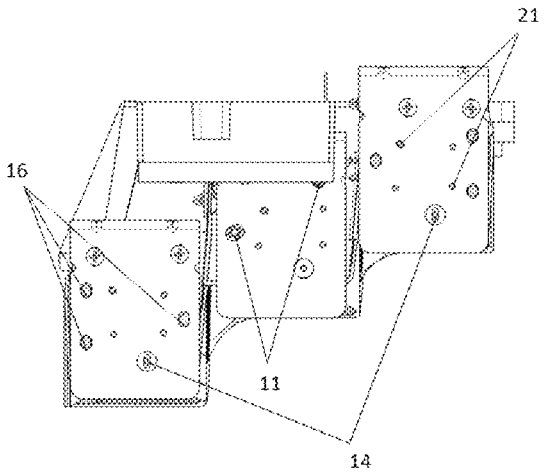
FIG. 3 is a top view of FIG. 1.
Figure 4:
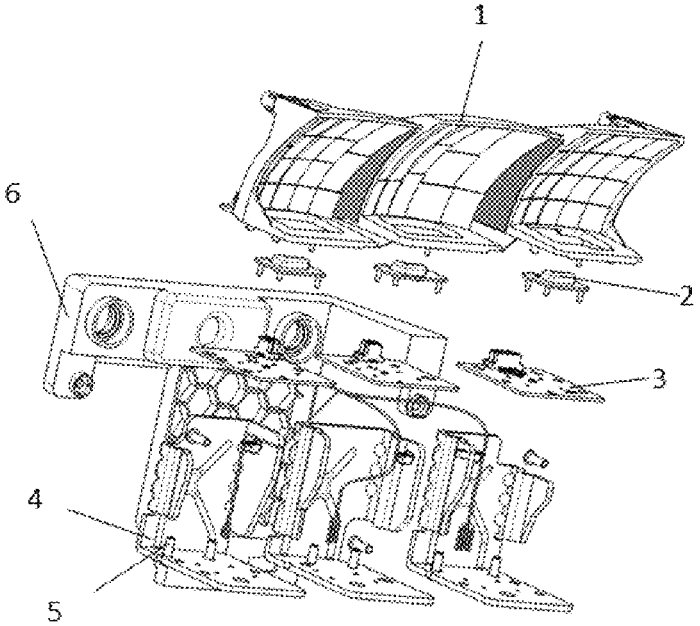
FIG. 4 is one decomposition schematic diagram of FIG. 1.
Figure 12:
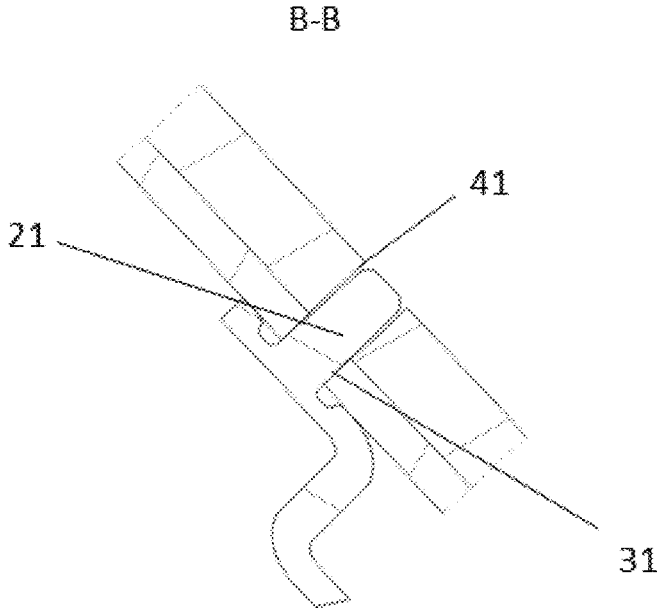
FIG. 12 is a B-B profile schematic diagram of FIG. 10.
Figure 13:
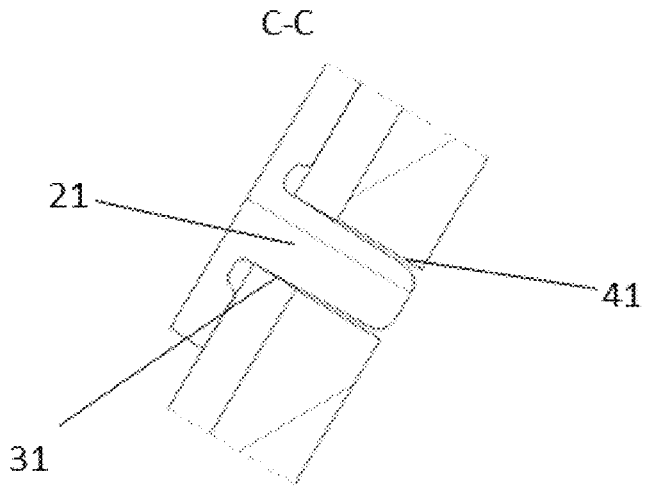
FIG. 13 is a C-C profile schematic diagram of FIG. 10.

According to the selection of the materials of the above components, the technical solution adopts the following positioning structures and connecting structures:

A first positioning structure is arranged between the light shield 2 and the circuit board 3, so that direct positioning of the light shield 2 and the circuit board 3 is realized through the first positioning structure. Specifically, the first positioning structure includes a plurality of light shield positioning plugs 21 arranged on the light shield 2 and light shield positioning sockets 31 which are arranged on the circuit board 3 and correspond to the light shield positioning plugs 21, and the light shield positioning plugs 21 can pass through the light shield positioning sockets 31 to accurately position the light shield 2 and the circuit board 3. As shown in FIG. 3 to FIG. 5 which illustrate a preferred implementation mode of the present invention, the number of the light shield positioning plugs 21 and the number of the light shield positioning sockets 31 are both two, and conventionally, in order to avoid over-positioning, one of the light shield positioning sockets 31 is a waist-shaped opening, the outer surface of the light shield positioning plug 21 corresponding to the waist-shaped opening is attached to the two inner side planes of the waist-shaped opening (as shown in the FIG. 13); and the another light shield positioning socket 31 is a round hole, and the outer surface of the light shield positioning plug 21 corresponding to the round hole is attached to the inner surface of the round hole (as shown in FIG. 12).

The light shield 2 and the circuit board 3 are directly positioned and do not need to be positioned with the radiator 4, but in order to facilitate processing and assembling, the radiator 4 corresponding to the circuit board 3 is provided with a first through hole 41 for the light shield positioning plug 21 to pass through, and the light shield positioning plug 21 is not in contact with the inner wall of the first through hole 41.

As shown in FIG. 3-FIG. 21, a second positioning structure is arranged between at least one reflector 1 and the circuit board 3, so that direct positioning of the reflector 1 and the circuit board 3 is realized through the second positioning structure. The second positioning structure includes a plurality of reflector positioning plugs 11 arranged on the reflector 1 and reflector positioning sockets 33 which are arranged on the circuit board 3 and correspond to the reflector positioning plugs 11, and the reflector positioning plugs 11 can pass through the reflector positioning sockets 33 to accurately position the reflector 1 and the circuit board 3. As a preferred mode of the present invention, the number of the reflector positioning plugs 11 and the number of the reflector positioning sockets 33 are respectively two. Similarly, in order to avoid over-positioning, one of the two reflector positioning sockets 33 is a waist-shaped opening, and the outer surface of the reflector positioning plug 11 corresponding to the kidney-shaped opening is attached to the two inner side planes of the waist-shaped opening; the another reflector positioning socket 33 is a round hole, and the outer surface of the reflector positioning plug 11 corresponding to the round hole is attached to the inner surface of the round hole.

The reflector 1 and the circuit board 3 are directly positioned and do not need to be positioned with the radiator 4, but in order to facilitate processing and assembling, the radiator 4 corresponding to the circuit board 3 is provided with a second through hole 43 for the reflector positioning plug 11 to pass through, and the reflector positioning plug 11 is not in contact with the inner wall of the second through hole 43.

According to one implementation mode of the present invention, the light shield 2, the circuit board 3 and the radiator 4 are connected through the following structure: the light shield 2 is provided with at least one light shield riveting column 22, and the circuit board 3 is provided with circuit board connecting holes 32 corresponding to the light shield riveting columns 22; the radiator 4 corresponding to the circuit board 3 is provided with radiator connecting holes 42 corresponding to the light shield riveting columns 22, and the light shield riveting columns 22 sequentially penetrate through the circuit board connecting holes 32 and the radiator connecting holes 42 to rivet the light shield 2, the circuit board 3 and the radiator 4. As shown in the FIG. 11, the number of the light shield riveting columns 22, the number of the circuit board connecting holes 32 and the number of the radiator connecting holes 42 are all two, the light shield riveting columns 22 can sequentially pass through the circuit board connecting holes 32 and the radiator connecting holes 42 so as to rivet the light shield 2, the circuit board 3 and the radiator 4, and due to the fact that the light shield riveting columns 22 and the light shield 2 are made of the same material and are both metal pieces, the riveting of the light shield riveting columns 22 with the circuit board 3 and the radiator 4 is cold riveting. In order to improve the thermal durability of the vehicle lamp module, as shown in the FIG. 11, gaps for the light shield riveting columns 22 to move in the connecting holes exist between the outer surfaces of the light shield riveting columns 22 and the inner surfaces of the circuit board connecting holes 32 and the radiator connecting holes 42.

Preferably, the light shield positioning plug 21 and the light shield riveting column 22 are made of metal materials and are good in heat conduction performance, and heat conduction glue can be arranged between the light shield positioning plug 21 and the light shield riveting column 22 and the circuit board 3 to achieve heat conduction and improve heat dissipation efficiency.

As one implementation mode of the present invention, the reflector 1, the circuit board 3 and the radiator 4 are connected through the following structure: the reflector 1 is provided with mounting holes 12, the circuit board 3 and the corresponding radiator 4 are respectively provided with via holes 34 and via hole 44, then the via holes 34 and the via holes 44 connect with the mounting holes 12 through fasteners such as screws 5 or bolts, so that the radiator 4, the circuit board 3 and the reflector 1 are fixedly connected. When a screw 5 is used for connection, the mounting hole 12 is a threaded hole matched with the screw 5.

Figure 14:
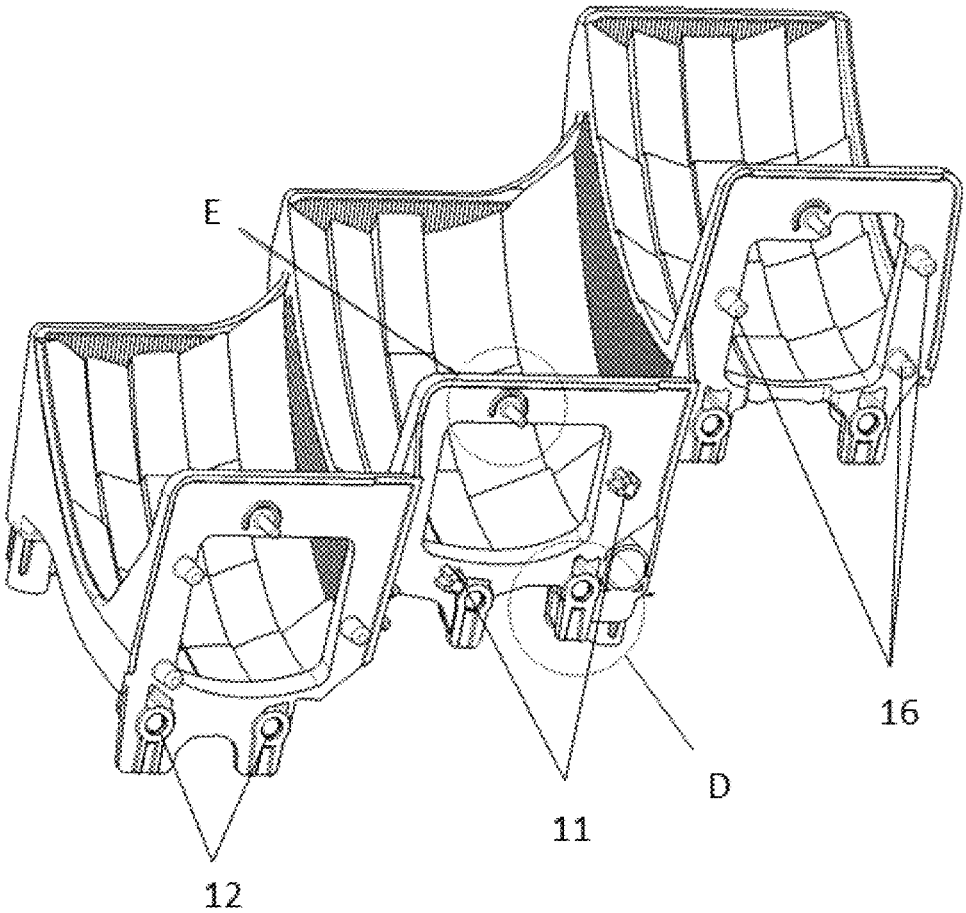
FIG. 14 is a structural diagram of the reflector in the present invention.
Figure 15:
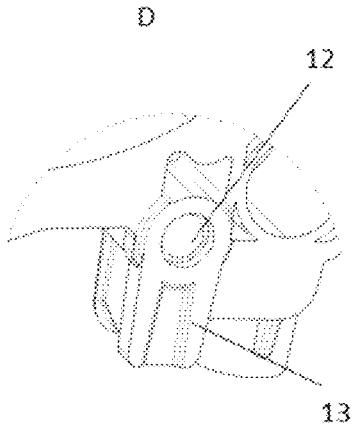
FIG. 15 is an amplified schematic diagram at D in FIG. 14.

As shown in FIG. 14, as the mounting hole 12 in the reflector 1 is arranged in the rear end of the reflector 1, after a screw 5 or a bolt is screwed down, the front end of the reflector 1 tends to tilt upwards due to the fact that the rear end of the reflector 1 is stressed, namely, the reflector 1 will overturn backwards, and as an improvement mode, as shown in FIG. 15, in order to inhibit the reflector 1 from overturning backwards, a first convex rib 13 protruding out of the lower surface of the reflector 1 is arranged on the periphery of the mounting hole 12, the first convex rib 13 is in contact with the upper surface of the circuit board 3, and when the reflector 1 overturns backwards, the first convex rib 13 can inhibit the reflector 1 from overturning backwards. As another improvement mode, the front end of the reflector 1 can be riveted with the front end of the circuit board 3, specifically, the lower surface of the reflector 1 is provided with a reflector riveting column 14, the circuit board 3 is provided with a riveting hole 35 matched with the reflector riveting column 14, and backward overturning of the reflector 1 can be inhibited by hot riveting between the front end of the reflector 1 and the circuit board 3.

Figure 16:
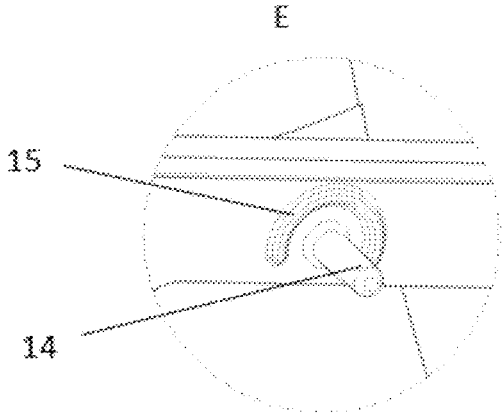
FIG. 16 is an amplified schematic diagram at E in FIG. 14.
Figure 17:
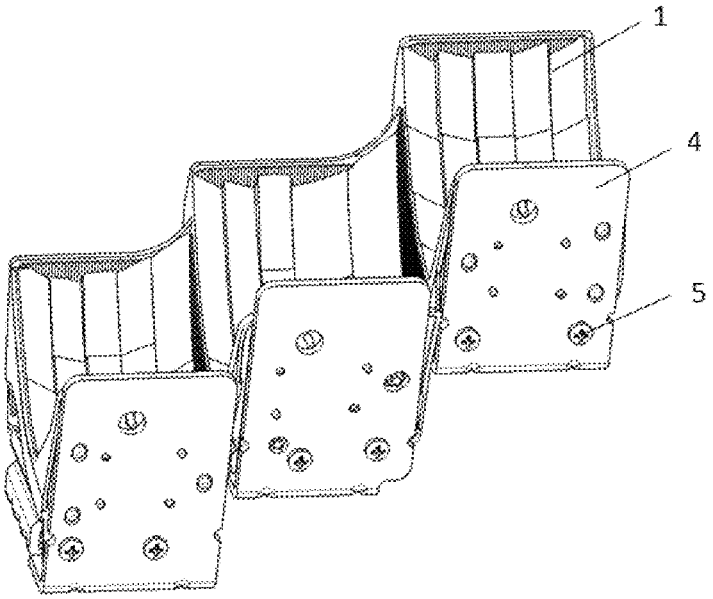
FIG. 17 is a schematic diagram of the assembly structure of the reflector, the light shield, the circuit board and the radiator in the present invention.

However, after the front end of the reflector 1 is riveted with the circuit board 3, as the front end of the reflector 1 is stressed, the rear end of the reflector 1 tends to tilt upwards, namely, the reflector 1 can overturn forwards, in order to inhibit the reflector 1 from overturning forwards, as shown in the FIG. 16, a second convex rib 15 is arranged on the periphery of the reflector riveting column 14; and the second convex rib 15 is in contact with the upper surface of the circuit board 3, and when the reflector 1 overturns forwards, the second convex rib 15 can inhibit the reflector 1 from overturning forwards.

The lower surfaces of the first convex rib 13 and the second convex rib 15 are also positioning surfaces of the reflector 1 in the up-and-down direction.

A plurality of reflectors 1 can be arranged and used for forming a plurality of light forms, the plurality of light forms can be overlapped to form a complete vehicle lamp light form, and in the light distribution process, the relative positions of the plurality of light forms need to be adjusted firstly, and then the position of the whole vehicle lamp light form needs to be adjusted. Wherein, the relative positions of the plurality of light forms can be adjusted by adjusting the position of the reflector 1 relative to the light source on the circuit board 3.

Figure 1:
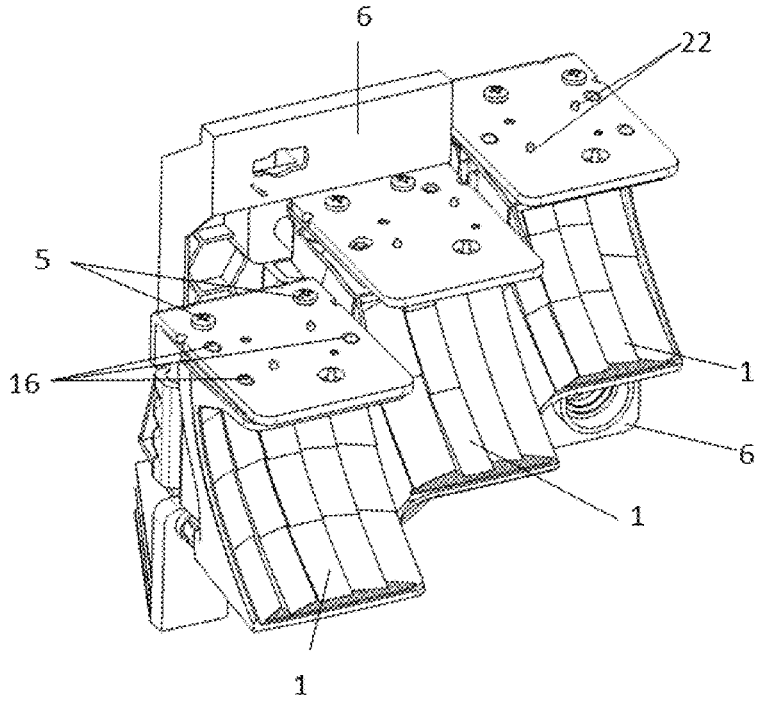
FIG. 1 is a three-dimensional structure schematic diagram of one embodiment of the reflective vehicle lamp module in the present invention.
Figure 2:
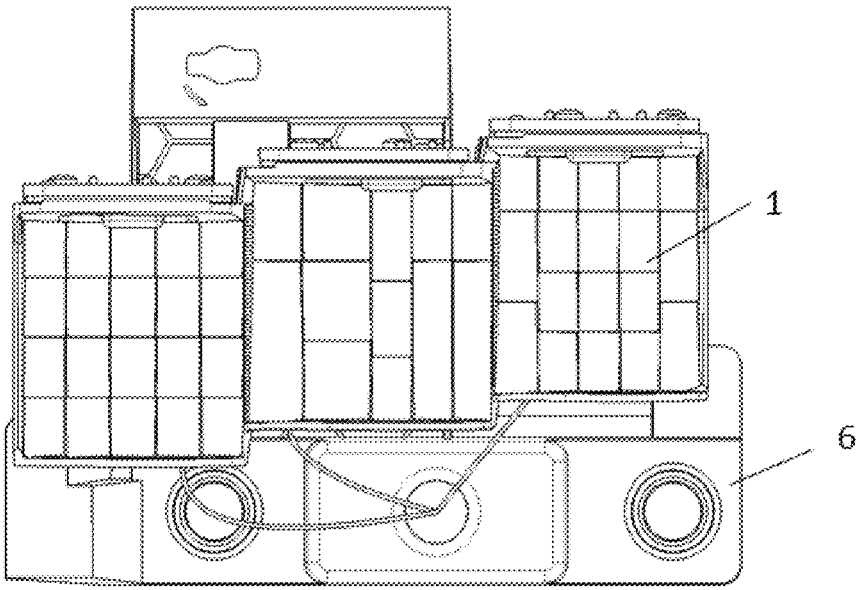
FIG. 2 is a front view of FIG. 1.
Figure 22:
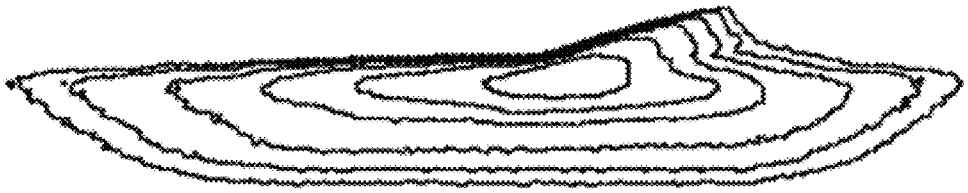
FIG. 22 is a main low-beam light form schematic diagram correspondingly formed by the main low-beam reflector in the present invention.
Figure 23:
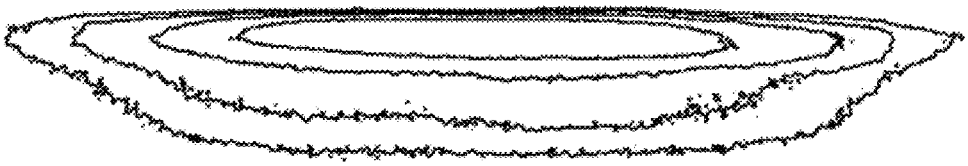
FIG. 23 is an auxiliary low-beam light form schematic diagram correspondingly formed by the auxiliary low-beam reflector in the present invention.
Figure 24:
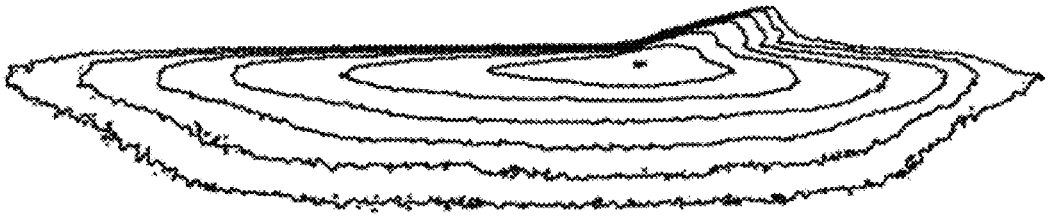
FIG. 24 is a low-beam light form schematic diagram (superposition of main low-beam and auxiliary low-beam) of the reflective vehicle lamp module in the present invention.
Figure 25:
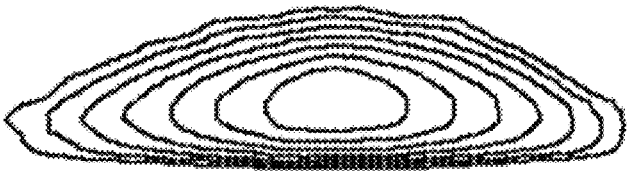
FIG. 25 is a high-beam light form schematic diagram correspondingly formed by the high-beam reflector in the present invention.

The high-low-beam integrated vehicle lamp module with three reflectors 1 is taken as an example, the three reflectors 1 are a main low-beam reflector, an auxiliary low-beam reflector and a high-beam reflector, and the three reflectors 1 are correspondingly used for forming a main low-beam light form (shown in the FIG. 22), an auxiliary low-beam light form (shown in the FIG. 23) and a high-beam light form (shown in the FIG. 25) respectively. The main low-beam light form and the auxiliary low-beam light form are overlapped to form a complete low-beam light form (shown in FIG. 24). The positions of the three reflectors 1 can be set at will, and the auxiliary low-beam reflector and the high-beam reflector shown in the FIG. 1 are located on the left side and the right side of the main low-beam reflector respectively. In order to improve the illuminance of the main low-beam area, the light-emitting area of the light source corresponding to the main low-beam reflector is smaller than that of the light sources corresponding to the other two reflectors, and the light-emitting area of the light source corresponding to the main low-beam reflector is smaller than or equal to 0.5 mm2.

When the reflective vehicle lamp module is assembled, in order to align a cut-off line of the main low-beam light form with a cut-off line of the auxiliary low-beam light form and enable the relative position between the main low-beam light form and the high-beam light form to be accurate, the relative position of each light form needs to be adjusted, namely, so-called dimming, so that the relative position of each light form conforms to laws and regulations, and the light form effect is ensured. In the dimming process, one light form needs to serve as a reference light form to adjust the positions of the other two light forms relative to the reference light form, for example, the main low-beam light form serves as the reference light form, namely, the main low-beam light reflector and the circuit board 3 are accurately positioned, the second positioning structure is arranged between the main low-beam reflector and the circuit board 3 corresponding to the main low-beam reflector. Dimming structures capable of enabling the auxiliary low-beam reflector and the high-beam reflector to move relative to the corresponding circuit boards 3 are arranged between the auxiliary low-beam reflector and the corresponding circuit board 3 and between the high-beam reflector and the corresponding circuit board 3.

In the vehicle lamp module provided by the embodiment of the present invention, the relative movement of the reflector 1 and the corresponding circuit board 3 can be realized by the following two structural forms:

According to a first structural form, a plurality of reflectors 1 are integrated pieces [firstly, PC (Polycarbonate), PMMA (polymethyl methacrylate) or BMC (bulk molding compound) is integrally formed, and then aluminum is plated on the surface of the reflector 1 serving as a reflecting surface to form the reflecting surface], and each reflector 1 corresponds to one circuit board 3 and one radiator 4; the circuit boards 3 corresponding to the auxiliary low-beam reflector and the high-beam reflector can move relative to the auxiliary low-beam reflector and the high-beam reflector, namely, the dimming structure can enable a small assembly arranged by fixedly connecting the light shield 2, the circuit board 3 and the radiator 4 to move relative to the reflector 1, so that the light source and the light shield 2 move relative to the reflector 1.

According to a second structural form, the circuit boards 3 and/or the radiators 4 corresponding to the plurality of reflectors 1 are integrally formed, the plurality of reflectors 1 are mutually separated and independent, and the auxiliary low-beam reflector and the high-beam reflector can move relative to the corresponding circuit boards 3. The dimming structure can enable the reflector 1 to move relative to a small assembly arranged by fixedly connecting the light shield 2, the circuit board 3 and the radiator 4, so that the reflector 1 moves relative to the light source and the light shield 2.

The relative movement can be front-back movement or up-and-down movement or movement in other directions as long as the relative positions of the light forms can be adjusted.

Figure 18:
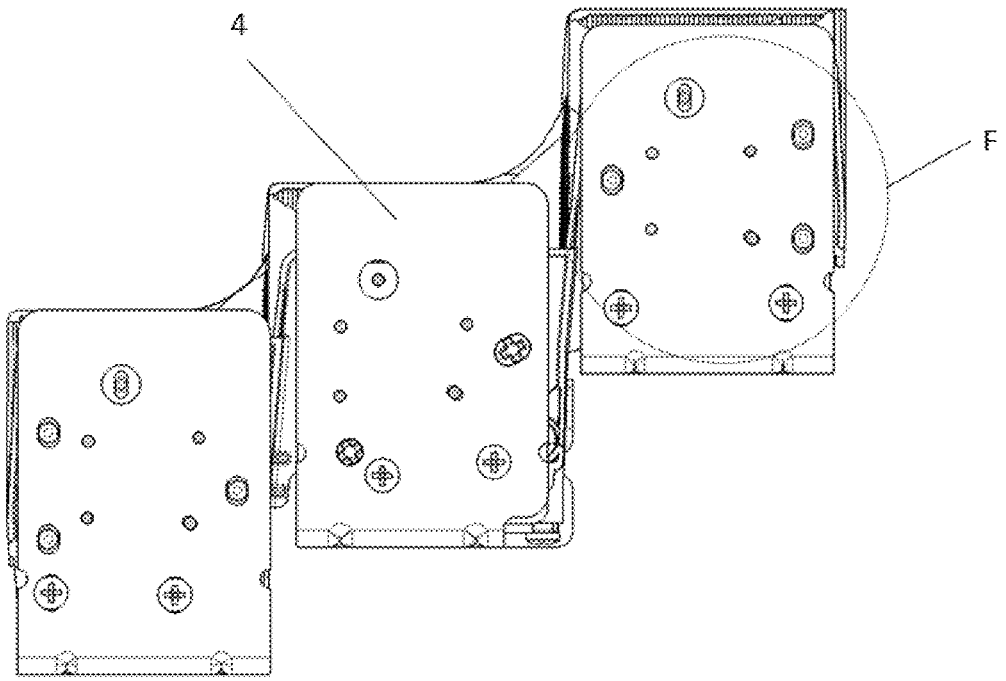
FIG. 18 is a bottom view of FIG. 17.
Figure 19:
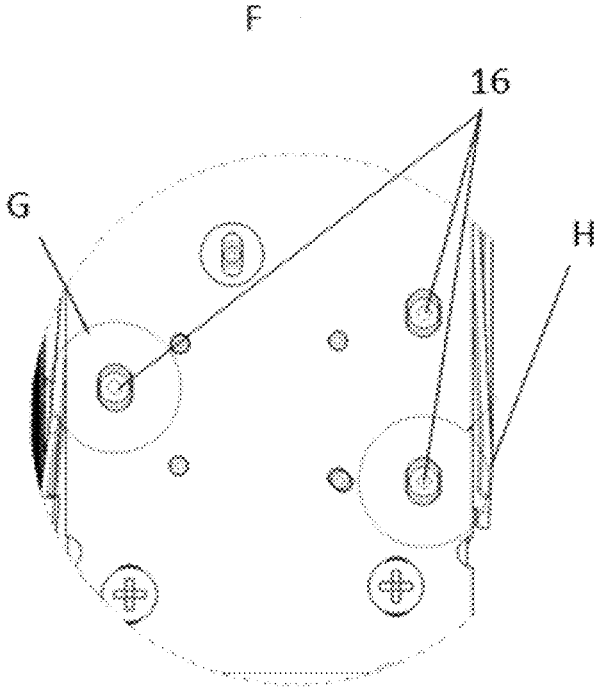
FIG. 19 is an amplified schematic diagram at F in FIG. 18.

As an implementation mode, the structure of the dimming structure is specifically explained in the first structural form, as shown in FIG. 18-FIG. 19, the main low-beam reflector is fixedly connected with the circuit board 3 and the radiator 4 by taking the main low-beam light form as a positioning reference, the reflector positioning plug 11 is arranged on the main low-beam reflector, and the reflector positioning socket 33 is arranged on the circuit board 3 corresponding to the main low-beam reflector, and the dimming structure includes at least one guide column 16 arranged on the left and right sides of the auxiliary low-beam reflector and the high-beam reflector respectively and circuit board guide holes 36 which are arranged in the circuit board 3 and correspond to the guide columns 16. The circuit board guide hole 36 extends in the front-back direction of the circuit board 3. The guide column 16 can move in the front-back direction along the circuit board guide hole 36 so as to achieve the relative position of a small assembly formed by the light shield 2, the circuit board 3 and the radiator 4 corresponding to the auxiliary low-beam reflector and the high-beam reflector relative to the auxiliary low-beam reflector and the high-beam reflector in the front-back direction, namely the positions of the light source and the reflector 1 in the front-back direction can be achieved, and finally, the relative positions of the auxiliary low-beam light form and the high-beam light form relative to the main low-beam light form in the up-and-down direction are adjusted.

Figure 20:
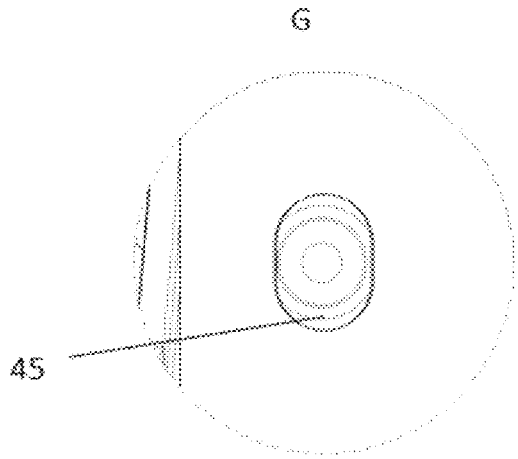
FIG. 20 is an amplified schematic diagram at G in FIG. 19.
Figure 21:
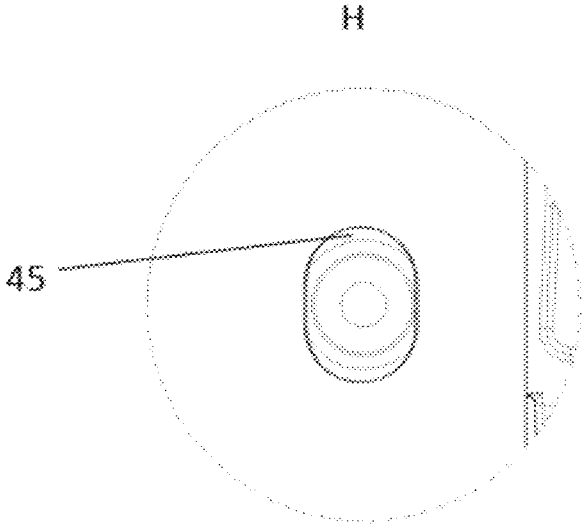
FIG. 21 is an amplified schematic diagram at H in FIG. 19.

Meanwhile, the guide columns 16 and the circuit board guide holes 36 also serve as limiting structures of a small assembly in the left-right direction, the small assembly is formed by the light shield 2, the circuit board 3 and the radiator 4 corresponding to the auxiliary low-beam reflector and the high-beam reflector, and therefore the small assembly can only move in the front-back direction. Specifically, the outer side edge of the guide column 16 is in contact with the inner wall of the circuit board guide hole 36; the inner side edge of the guide column 16 is not in contact with the inner wall of the circuit board guide hole 36 (here, the inner side of the inner side edge refers to the direction pointing to the center of the auxiliary low-beam reflector or the high-beam reflector, and the outer side of the outer side edge refers to the direction away from the center thereof). As an implementation mode of the present invention, as shown in FIG. 20-FIG. 21, the right side edge of the guide column 16 located on the right side is attached to the right side edge of the corresponding circuit board guide hole 36, and a gap is arranged between the left side edge of this guide column 16 and the left side edge of the corresponding circuit board guide hole 36; the left side edge of the guide column 16 located on the left side is attached to the left side edge of the corresponding circuit board guide hole 36, and a gap is arranged between the right side edge of this guide column 16 and the right side edge of the corresponding circuit board guide hole 36.

If the left and right sides of the auxiliary low-beam reflector and the left and right sides of the high-beam reflector are each provided with one guide column 16, the guide columns 16 are cylinders, and the circuit board guide holes 36 are strip-shaped holes, when a special machine pushing mechanism is used for pushing the small assembly, due to the fact that the two guide columns 16 and the two circuit board guide holes 36 are in point contact, the small assembly is easy to rotate in the front-back moving process, so that the dimming is inaccurate; if the guide columns 16 are arranged to be strip-shaped columns, and the circuit board guide holes 36 are arranged to be strip-shaped holes, the guide columns 16 and the circuit board guide holes 36 are in line contact, the small assembly is prone to being stuck due to rotation in the front-back moving process. Therefore, as shown in the FIG. 18, as a preferable implementation mode, the guide columns 16 are cylinders, one guide column 16 is arranged on one side of the auxiliary low-beam reflector, two guide columns 16 are arranged on the other side of the auxiliary low-beam reflector, and the outer side edges of the two circuit board guide holes 36 corresponding to the two guide columns 16 located on the same side are located on the same straight line. One side of the high-beam reflector is provided with one guide column 16, the other side of the high-beam reflector is provided with two guide columns 16, and the outer side edges of the two circuit board guide holes 36 corresponding to the two guide columns 16 located on the same side are located on the same straight line. Due to the fact that the three guide columns 16 and the three circuit board guide holes 36 are in point contact, and the contact points of the two guide columns 16 are located on the same straight line, such a structure will not cause the small assembly rotate in the front-back moving process, nor will occur the stuck phenomenon.

Radiator guide holes 45 corresponding to the circuit board guide holes 36 are arranged in the radiators 4 corresponding to the auxiliary low-beam reflector and the high-beam reflector, and the guide columns 16 sequentially pass through the circuit board guide holes 36 and the radiator guide holes 45.

Due to the fact that the small assembly needs to move relative to the reflector 1 in the front-back direction, the via holes 34 and 44 in the circuit board 3 and the radiator 4 corresponding to the auxiliary low-beam reflector and the high-beam reflector and the riveting holes 35 in the circuit board 3 are strip-shaped holes extending front and back. When the dimming is complete, the small assembly and the reflector 1 are connected and fixed through a screw 5 or a bolt and are riveted through a reflector riveting column 14.

Figure 26:
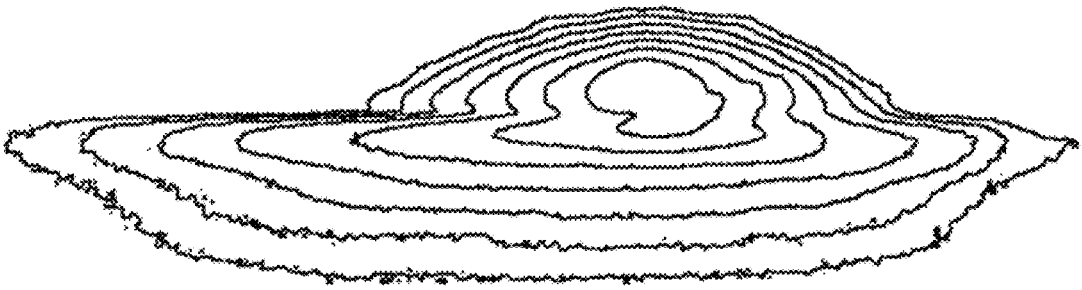
FIG. 26 is a vehicle lamp light form schematic diagram (superposition of low-beam and high-beam) of the reflective vehicle lamp module in the present invention.

The vehicle lamp module further includes a support 6, and the reflector 1 is fixed to the support 6. After dimming of the relative positions of the light forms is finished, overall dimming can be performed on the reflective vehicle lamp module by adjusting the support 6, and the vehicle lamp light form shown in the FIG. 26 is made to be located at its theoretical position.

On the second aspect, the present invention further provides a vehicle lamp which includes the above vehicle lamp module.

On the third aspect, the present invention provides a vehicle with the above vehicle lamp.

According to the above description, the circuit board 3 is taken as a reference, the light shield 2 and the reflector 1 are respectively and directly positioned with the circuit board 3, accurate and good positioning among the vehicle lamp optical element systems composed of the circuit board 3, the light shield 2 and the reflector 1 is realized, the radiator 4 only plays a role in heat dissipation and does not play a role in positioning. Position errors caused by indirect positioning between the optical elements due to the fact that the radiator 4 serves as a positioning piece are avoided, the light form effect is guaranteed, and the module performance is improved. In order to be matched with a positioning structure, the light shield 2, the circuit board 3 and the radiator 4 are connected in a riveting mode, and reliable connection is guaranteed. The dimming structure is provided, the relative positions of the auxiliary low-beam light form and the high-beam light form relative to the main low-beam light form in the up-and-down direction can be adjusted, all the light forms meet the requirements of laws and regulations, and the light form effect is ensured; the material characteristic design of each part has a positioning structure different from that in the prior art, the light shield 2 is made of a high-strength metal material, so that the service life of the light shield 2 can be prolonged, structures such as a positioning plug and a riveting column can be arranged on the light shield 2, and the heat dissipation performance can be improved.

The preferable implementation modes of the present invention are described in detail in combination with the attached drawings, however, the present invention is not limited to the specific details in the above implementation modes, in the technical concept range of the invention, the technical solution of the present invention can be subjected to various simple variations, and the simple variations all belong to the protection range of the present invention.

In addition, it needs to be explained that all the specific technical characteristics described in the specific implementation modes can be combined in any appropriate mode under the non-contradictory condition, and in order to avoid unnecessary repetition, all possible combination modes are not explained any more.

In addition, various different implementation modes of the present invention can also be combined at will, and as long as the implementation modes do not violate the idea of the present invention, the implementation modes also should be regarded as the content disclosed by the present invention.

The invention claimed is:

1. A vehicle lamp module, characterized by comprising a plurality of circuit boards, a plurality of reflectors and light shields in one-to-one correspondence with the reflectors and the circuit boards, wherein a plurality of light shield positioning plugs are arranged on a light shield of the light shields, and light shield positioning sockets corresponding to the light shield positioning plugs are arranged in a circuit board of the plurality of circuit boards to realize direct positioning of the light shield and the circuit board;

one reflector of the plurality of reflectors is provided with a plurality of the reflector positioning plugs, and the circuit board corresponding to the reflector is provided with reflector positioning sockets corresponding to the reflector positioning plugs to realize direct positioning of the reflector and the circuit board; and dimming structures enabling other reflectors to move relative to the corresponding circuit boards are arranged between the other reflectors and the corresponding circuit boards.

2. The vehicle lamp module according to claim 1, characterized in that first through holes for the light shield positioning plugs to pass through are arranged in a radiator of a plurality of radiators corresponding to the circuit board, and the light shield positioning plugs are not in contact with an inner wall of the first through hole, and heat-conducting glue is arranged between the light shield positioning plug and the circuit board.

3. The vehicle lamp module according to claim 1, characterized in that the plurality of reflector positioning plugs arranged on the one reflector are two reflector positioning plugs.

4. The vehicle lamp module according to claim 1, characterized in that second through holes for the reflector positioning plugs to pass through are arranged in a radiator of a plurality of radiators corresponding to the circuit board, and the reflector positioning plugs are not in contact with an inner wall of the second through hole.

5. The vehicle lamp module according to claim 1, characterized in that the dimming structure further comprises at least one guide column arranged on a bottom face of each of the other reflectors and circuit board guide holes which are arranged in the corresponding circuit board and correspond to the guide columns, and the circuit board guide holes extend in the front-back direction of the circuit board.

6. The vehicle lamp module according to claim 5, characterized in that the outer side edge of the guide column is in contact with the inner wall of the circuit board guide hole, and the inner side edge of the guide column is not in contact with the inner wall of the circuit board guide hole.

7. The vehicle lamp module according to claim 5, characterized in that the guide columns are cylinders, one guide column is arranged on one side of each of the other reflectors, two guide columns are arranged on the other side of each of the other reflectors, and the outer side edges of the two circuit board guide holes corresponding to the two guide columns located on the same side are located on the same straight line.

8. The vehicle lamp module according to claim 5, characterized in that radiator guide holes corresponding to the circuit board guide holes are arranged in a radiator of a plurality of radiators corresponding to the circuit board, and the guide columns sequentially pass through the circuit board guide holes and the radiator guide holes.

9. The vehicle lamp module according to claim 1, characterized in that at least one light shield riveting column is arranged on the light shield, circuit board connecting holes corresponding to the light shield riveting columns are arranged in the circuit board, radiator connecting holes corresponding to the light shield riveting columns are arranged in a radiator of a plurality of radiators corresponding to the circuit board, and the light shield riveting columns sequentially pass through the circuit board connecting holes and the radiator connecting holes to rivet the light shield, the circuit board and the radiator, and heat-conducting glue is arranged between the light shield riveting column and the circuit board.

10. The vehicle lamp module according to claim 9, characterized in that gaps allowing the light shield riveting columns to move in the connecting holes exist between the outer surfaces of the light shield riveting columns and the inner surfaces of the circuit board connecting holes and the radiator connecting holes.

11. The vehicle lamp module according to claim 1, characterized in that mounting holes are arranged in the reflector, the circuit board and a radiator of a plurality of radiators corresponding to the circuit board are respectively provided with via holes, and the via holes are connected with the mounting holes through fasteners to enable the fixed connection among the radiator, the circuit board and the reflector.

12. The vehicle lamp module according to claim 11, characterized in that a first convex rib protruding out of the lower surface of the reflector is arranged on the periphery of the mounting hole, and the first convex rib is in contact with the upper surface of the circuit board.

13. The vehicle lamp module according to claim 11, characterized in that a reflector riveting column is arranged on the lower surface of the reflector, and a riveting hole matched with the reflector riveting column is arranged in the circuit board.

14. The vehicle lamp module according to claim 13, characterized in that a second convex rib is arranged on the periphery of the reflector riveting column, and the second convex rib is in contact with the upper surface of the circuit board.

15. A vehicle lamp, characterized by comprising the vehicle lamp module according to claim 1.

16. The vehicle lamp according to claim 15, characterized in that the dimming structure comprises at least one guide column arranged on a bottom face of each of the other reflectors and circuit board guide holes which are arranged in the corresponding circuit board and correspond to the guide columns, and the circuit board guide holes extend in the front-back direction of the circuit board.

17. The vehicle lamp according to claim 16, characterized in that the guide columns are cylinders, one guide column is arranged on one side of each of the other reflectors, two guide columns are arranged on the other side of each of the other reflectors, and the outer side edges of the two circuit board guide holes corresponding to the two guide columns located on the same side are located on the same straight line.

18. The vehicle lamp according to claim 16, characterized in that radiator guide holes corresponding to the circuit board guide holes are arranged in a radiator of a plurality of radiators corresponding to the circuit board, and the guide columns sequentially pass through the circuit board guide holes and the radiator guide holes.

19. The vehicle lamp according to claim 15, characterized in that at least one light shield riveting column is arranged on the light shield, circuit board connecting holes corresponding to the light shield riveting columns are arranged in the circuit board, radiator connecting holes corresponding to the light shield riveting columns are arranged in a radiator of a plurality of radiators corresponding to the circuit board, and the light shield riveting columns sequentially pass through the circuit board connecting holes and the radiator connecting holes to rivet the light shield, the circuit board and the radiator, and heat-conducting glue is arranged between the light shield riveting column and the circuit board.

20. The vehicle lamp according to claim 15, characterized in that mounting holes are arranged in the reflector, the circuit board and a radiator of a plurality of radiators corresponding to the circuit board are respectively provided with via holes, and the via holes are connected with the mounting holes through fasteners to enable the fixed connection among the radiator, the circuit board and the reflector.

* * * * *